US006811119B1

(12) United States Patent
Petersen et al.

(10) Patent No.: US 6,811,119 B1
(45) Date of Patent: Nov. 2, 2004

(54) AIRCRAFT SERVICE PIT LATCH

(75) Inventors: Craig Petersen, Costa Mesa, CA (US); Dennis Hernandez, Costa Mesa, CA (US)

(73) Assignee: Dabico, Inc., Costa Mesa, CA (US)

( * ) Notice: Subject to any disclaimer, the term of this patent is extended or adjusted under 35 U.S.C. 154(b) by 0 days.

(21) Appl. No.: 10/613,469

(22) Filed: Jul. 2, 2003

(51) Int. Cl.[7] ..... B65B 3/00
(52) U.S. Cl. ..... 244/114 R; 292/123
(58) Field of Search ..... 52/169.6, 169.7, 52/169.8, 169.9, 3, 4, 23; 292/227, 228, 123, 127, 97, 221, 223, 196; 244/114 R, 115, 116, 114 B; 70/168, 169; 49/136, 465; 220/484, 241, 242; 404/25; 24/641

(56) References Cited

U.S. PATENT DOCUMENTS

| | | | | | |
|---|---|---|---|---|---|
| 214,773 | A | * | 4/1879 | Hartel | 70/150 |
| 767,567 | A | * | 8/1904 | Keil | 292/127 |
| 886,165 | A | * | 4/1908 | Vore | 292/127 |
| 945,753 | A | * | 1/1910 | Chamberlain | 220/242 |
| 1,055,797 | A | * | 3/1913 | Redding | 70/169 |

(List continued on next page.)

*Primary Examiner*—Michael J. Carone
*Assistant Examiner*—Stephen Holzen
(74) *Attorney, Agent, or Firm*—Charles H. Thomas

(57) ABSTRACT

A buried subsurface pit for use beneath a surface across which aircraft travel for servicing aircraft is provided with a pit latching mechanism for holding and releasing a pit lid mounted atop the buried pit. A shallow latch operating lever storage recess is defined in the upper surface of the pit lid. An actuator rod passageway is formed in the pit lid and extends between the latch operating lever storage recess and the undersurface of the pit lid. A catch is located in alignment with the actuator rod passageway at the undersurface of the pit lid. The catch is mounted for rotation about a horizontal axis of catch rotation. An actuator rod is disposed for longitudinal, reciprocal movement in the actuator rod passageway. A latch operating lever has opposing latch handle and actuator rod engaging ends. The latch operating lever is mounted between its opposing ends to the pit lid proximate the upper surface of the pit lid for rotation on a fulcrum about a horizontal latch operating lever axis of rotation which is located just below the upper surface of the pit lid. The latch operating lever is movable between a stored position in the latch operating lever storage recess and an actuator rod engaging position in which the latch handle end of the latch operating lever is raised out of the latch operating lever storage recess so that the actuator rod operating end of the lever depresses the actuator rod to disengage the catch.

20 Claims, 7 Drawing Sheets

U.S. PATENT DOCUMENTS 1,213,992 A * 1/1917 Write ..... 70/169
1,591,383 A * 7/1926 Herzing ..... 292/127
1,654,729 A * 1/1928 Greene ..... 292/127
1,661,548 A * 3/1928 Stuart et al. ..... 292/127
1,687,969 A * 10/1928 Brown ..... 292/236
1,703,556 A * 2/1929 Stewart ..... 292/127
1,891,961 A * 12/1932 Taylor ..... 70/169
1,902,731 A * 3/1933 Sherman ..... 70/169
1,923,481 A * 8/1933 Ford ..... 220/484
2,009,132 A * 7/1935 Gehris ..... 49/465
2,117,160 A * 5/1938 Gale ..... 292/336.3
2,285,301 A * 6/1942 Nelson ..... 292/126
2,469,430 A * 5/1949 Bowlzer, Jr. ..... 292/124
3,126,728 A * 3/1964 Nehls ..... 70/169
3,402,958 A * 9/1968 Barry ..... 292/62
3,456,463 A * 7/1969 Mihalich ..... 70/168
3,888,526 A * 6/1975 Dennis ..... 292/97
3,921,494 A * 11/1975 Coe ..... 411/344
4,061,371 A * 12/1977 Prather et al. ..... 292/198
4,159,137 A * 6/1979 Richter ..... 292/123
4,174,128 A * 11/1979 Styck ..... 292/127
4,269,240 A * 5/1981 Cutore ..... 141/392
4,351,446 A * 9/1982 Madden ..... 220/210
4,487,449 A * 12/1984 Igel et al. ..... 296/216.07
4,520,897 A * 6/1985 Gebo ..... 182/92
4,739,896 A * 4/1988 Moss ..... 52/169.6
4,989,907 A * 2/1991 Edmonds et al. ..... 292/223
5,015,019 A * 5/1991 Razdolsky ..... 292/200
5,024,471 A * 6/1991 Kahl et al. ..... 292/97
5,082,392 A * 1/1992 Marchese et al. ..... 404/25
5,471,273 A * 11/1995 Kim ..... 396/536
5,542,162 A * 8/1996 Biller ..... 24/641
5,570,915 A * 11/1996 Asadurian ..... 292/242
5,595,224 A * 1/1997 Cutore ..... 141/388
D413,056 S * 8/1999 Sokurenko et al. ..... D8/331
5,984,383 A * 11/1999 Parikh et al. ..... 292/121
6,109,823 A * 8/2000 Halferty et al. ..... 404/25
6,199,414 B1 * 3/2001 Chang ..... 70/168
D452,808 S * 1/2002 Kyle ..... D8/331
D456,237 S * 4/2002 Sokurenko et al. ..... D8/307
D457,803 S * 5/2002 Weinerman et al. ..... D8/338
D459,192 S * 6/2002 Weinerman et al. ..... D8/338
6,540,269 B2 * 4/2003 Wurges et al. ..... 292/125
6,578,884 B2 * 6/2003 Chiang ..... 292/66
6,715,715 B1 * 4/2004 Petersen ..... 244/114 R
2003/0121675 A1 * 7/2003 Gingerich ..... 172/274

* cited by examiner

AIRCRAFT SERVICE PIT LATCH

BACKGROUND OF THE INVENTION

1. Field of the Invention

The present invention related to a latching or fastening mechanism for an access lid to a subsurface chamber for servicing aircraft.

2. Description of the Prior Art

At modern aircraft terminals the servicing of aircraft on the ground is frequently performed using subsurface pits, which are often prefabricated structures. Such aircraft servicing pits are installed at aircraft docking, fueling, and loading areas beneath the surface of the tarmac across which aircraft travel during docking and departure maneuvers. The pits form a subsurface chamber and are typically constructed of fiberglass, steel, concrete, or aluminum. These pits are often constructed as complete enclosures with surrounding walls, a floor, and an access lid at the top seated within a frame disposed about the neck of the prefabricated pit. When the lid is closed it lies substantially flush with the surface of the tarmac. Such pits are installed below the surface of loading and refueling aprons at aircraft terminals, remote parking locations, and aircraft maintenance bases.

The purpose of the pits is to allow ground support functions to be carried out from subsurface enclosures. These ground support functions include the provision of fuel, the provision of electricity to an aircraft while it is in the docking area, the provision of air for cooling the aircraft interior, the provision of pressurized air for starting the aircraft engines, and for other aircraft support activities on the ground. The use of subsurface pits eliminates the need for mobile trucks, carts, and other vehicles which are otherwise present in the loading area and which interfere with the arrival and departure of aircraft in the vicinity of a loading gate.

The use of subsurface pits also allows the provision of fuel, power, cooling and pressurized air, and other supplies from a central location. The necessary fluid supplies and electrical power can be generated or stored with a greater efficiency at a central location, as contrasted with mobile generating or supply vehicles.

The pits located below the aircraft terminal area house valves, junction boxes, cooling air terminations, and other terminal equipment that is temporarily connected to an aircraft that has been docked. Umbilical pipes and lines, otherwise housed within the pits, are withdrawn from them through hatches therein and are coupled to a docked aircraft to supply it with fuel, air for cooling the aircraft interior, pressurized air for starting the engines, and electrical power.

The pits are constructed with either hinged or totally removable lids that can be moved between open positions allowing access to the pits and closed positions which are flush with the surfaces of the docking, loading, or refueling areas across which aircraft travel and beneath which the pits are mounted. To ensure that the pit lids remain flush with the surrounding surfaces, it is desirable to employ a latching mechanism. Very typically such a latching mechanism involves a catch depending from the underside of the edge of the pit lid remote from the hinge about which the pit lid is rotatably mounted to its surrounding frame. The catch engages a latch bar secured to the interior wall of the pit. The catch is normally moved in rotation about a horizontal axis by means of a lever arm located in a cavity at the underside of the pit lid remote from the axis at which the pit lid is mounted to the frame. Access to this cavity to operate the latch mechanism is normally provided by a gap between the frame and the pit lid adjacent to the lever arm.

To open the pit lid the user inserts the fingers of one hand into the gap and beneath the lever arm at the underside of the pit lid. The user then presses upwardly on the lever arm, thereby rotating it. The lever arm and catch mechanism operate in the manner of a bell crank, so that rotation of the latching mechanism lever arm pulls the catch from beneath the latch bar and allows the user to open the pit lid. One prior mechanism of this type is described in U.S. Pat. No. 4,739,896, which is hereby incorporated by reference in its entirety.

One difficulty with conventional latch mechanisms of this type that has persisted throughout the years is that the gap that provides access to the pit latch lever arm and the cavity in which the lever arm is mounted often becomes clogged with dirt and debris so that the user must first clean out these areas in order to free the pit lid latch lever arm so that it may be moved. Since the gap at the edge of the pit lid is located below grade and the cavity in which the pit latch lever arm is located lies underneath the edge of the pit lid, it is often quite difficult to clean out the dirt and other loading apron and runway debris that collects in order to free the lever arm of the latch mechanism.

SUMMARY OF THE INVENTION

The present invention provides a unique latching mechanism for an aircraft service pit lid that overcomes the difficulties of the prior art devices described. More specifically, the aircraft service pit latch mechanism of the present invention provides an actuating rod that acts through the structure of the pit lid, rather than externally at the pit lid edge. Moreover, the unique latching structure of the present invention allows the cavity in which the latch actuating lever is seated to be located at the upper surface of the pit lid, rather than at the undersurface of the lid. Nevertheless, the latch lever arm is constructed in such a manner that its seats snugly within an upwardly facing recess on the top of the pit lid. As a consequence, there is relatively little space within which dirt can collect and it is much easier to clean any dirt and debris from around the edges of the latch handle seated in the lever arm seating recess, since there is easy access to this area.

In one broad aspect the present invention may be considered to be an aircraft servicing pit latch mechanism for holding and releasing a pit lid mounted in a frame atop a subsurface aircraft servicing pit. The pit lid has an upper surface and also an undersurface. The latch mechanism of the invention is comprised of a latch or operating lever storage recess defined in the upper surface of the pit lid, an actuator rod passageway formed in the pit lid and extending between the latch operating lever storage recess and the underside of the pit lid, a catch located in alignment with the actuator rod passageway at the undersurface of the pit lid and mounted for rotation about a horizontal axis of catch rotation, an actuator rod disposed for reciprocal movement in the actuator rod passageway, and a latch operating lever. The latch operating lever has opposing latch handle and actuator rod operating ends. The latch handle is mounted between its opposing ends to the pit lid at a fulcrum about a horizontal latch operating lever axis of rotation. The latch operating lever is thereby mounted for movement between a stored position residing within the lateral confines of the latch operating lever storage recess and an actuator rod engaging position. When the latch operating lever is in the actuator rod engaging position the latch handle end is raised out of the latch operating lever storage recess while the actuator rod operates and depresses the actuator rod to disengage the catch.

The actuator rod has opposing upper and lower ends. The pit latch mechanism of the invention is preferably further comprised of a of pair rollers, one located at each of the upper and lower ends of the actuator rod. The roller at the lower end of the actuator rod is mounted thereto on a lower roller axle oriented parallel to the axis of catch rotation. The roller at the upper end of the actuator rod is mounted thereto on an upper roller axle oriented parallel to the latch operating lever axis of rotation. The rollers are preferably comprised of roller bearings.

In a preferred embodiment of the invention the upper and lower axes of roller rotation are angularly displaced from each other by ninety degrees considered in a horizontal plane. Consequently, it is advisable to provide a longitudinal guideway in the actuator rod and a guide secured to the pit lid and projecting into the guideway to limit and restrict the actuator rod from rotation within the actuator rod passageway. This guide system ensures that the axis of rotation of the lower roller remains parallel to the axis of rotation of the catch and that the axis of rotation of the upper roller remains parallel to the axis of rotation of the latch operating lever.

Preferably the latch operating lever is an L-shaped structure and is provided with a handgrip at its latch handle end oriented at right angles relative to the pivoted portion of the latch operating lever. The latch handgrip that projects laterally from the latch handle end of the operating lever also resides within the lateral confines of the latch operating lever storage recess when the latch handle is in its stored position.

While the catch may be of the gravity operated type as described in prior U.S. Pat. No. 4,739,896, a spring is preferably provided on the underside of the pit lid to bias the catch toward and engaged position. Such a spring may be located within a shallow cavity in the underside of the pit lid above a portion of the catch located on the opposite side of the axis of catch rotation from the point of contact with the lower roller at the lower end of the actuator rod.

Preferably also the rod operating end of the actuator rod meets the structure of the pit lid to restrict rotation of the latch operating lever to an angle of less than ninety degrees. This ensures that when latch operating lever handle is released when the pit lid is lowered to its closed, horizontal position, the latch operating lever and its handle will drop back into the latch operating lever storage recess due to the force of gravity.

In another aspect the invention may be considered to be a latching mechanism for releaseably securing a pit lid having an upper surface and an undersurface and seated in a pit lid frame of a pit buried beneath a surface across which aircraft travel. The latching mechanism of the invention is comprised of a catch, a latch operating lever storage recess, an actuator rod passageway defined through the pit lid, an actuator rod mounted for reciprocal movement within the actuator rod passageway, and a latch operating lever. The catch depends from the undersurface of the pit lid and is mounted for rotational movement about a horizontal catch axis of rotation relative to the pit lid.

The catch may be moved between engaged and disengaged positions. The latch operating lever storage recess is formed in the upper surface of the pit lid vertically above the catch. The actuator rod passageway that is defined through the pit lid leads between the latch operating lever storage recess and the undersurface of the pit lid. The actuator rod is depressible to bear against the catch to disengage it from the pit. The latch operating lever has opposing handle and actuator rod operating ends. The latch operating lever is hinged to the pit lid between its opposing ends and is rotatable about a horizontal fulcrum. The latch operating lever may be rotated between a stored position residing within the lateral confines of the latch operating lever storage recess and a raised position in which the handle end is lifted out of the latch operating lever storage recess and in which the actuator rod operating end depresses the actuator rod into the actuator rod passageway.

In still another aspect the invention may be considered to be an improvement to a subsurface pit for use below a surface across which aircraft travel on the ground. Such a pit has a pit lid frame and the pit lid with an upper surface and an undersurface. The pit lid is set in the frame and can be lifted relative to the frame. A pivoted catch is located beneath the pit lid at the undersurface thereof. The catch is engageable with the pit to hold the pit lid seated in the frame. According to the improvement of the invention a latch operating lever storage recess is defined in the upper surface of the pit lid above the pivoted catch. An actuator rod passageway is defined through the pit lid and terminates in an upper opening in the latch operating lever storage recess and in a lower opening at the undersurface of the pit lid in registration with pivoted catch. An actuator rod is disposed in the actuator rod passageway for reciprocal movement therewithin. The actuator rod is depressible downwardly to bear against the pivoted catch to disengage the pivoted catch relative to the pit. The latch operating lever has opposing latch handle and reciprocating rod operating ends and is pivotally mounted between those ends to the pit lid proximate the upper surface thereof. The latch operating lever is rotatable between a catch engaging position lying completely within the lateral confines of the latch operating lever storage recess and a raised position in which the latch operating lever depresses the actuator rod downwardly to disengage the catch.

The invention may be described with greater clarity and particularity by reference to the accompanying drawings.

DESCRIPTION OF THE EMBODIMENT

Figure 1:
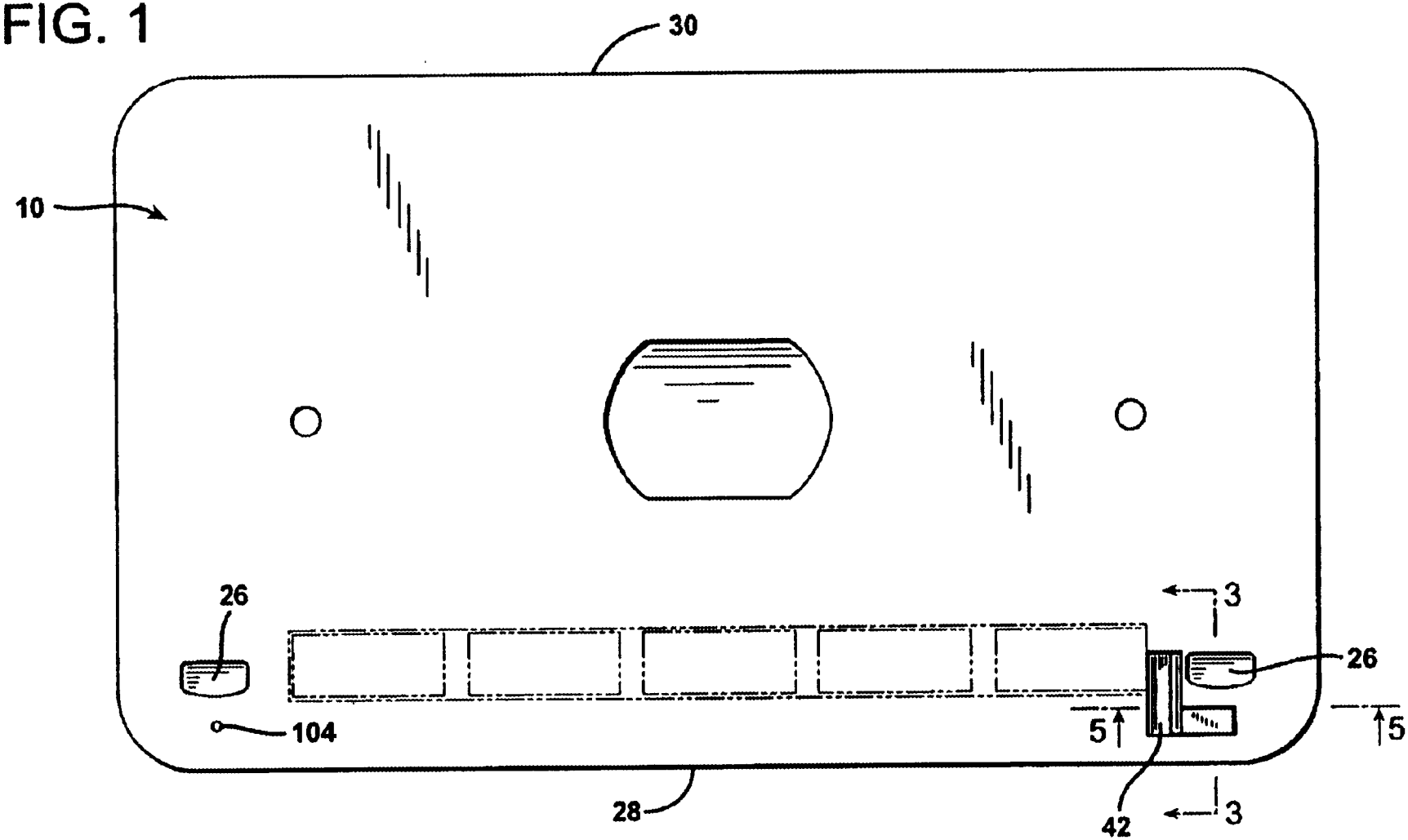
FIG. 1 is a top plan view of an aircraft servicing pit lid employing the aircraft servicing pit lid latch mechanism of the invention.
Figure 3:
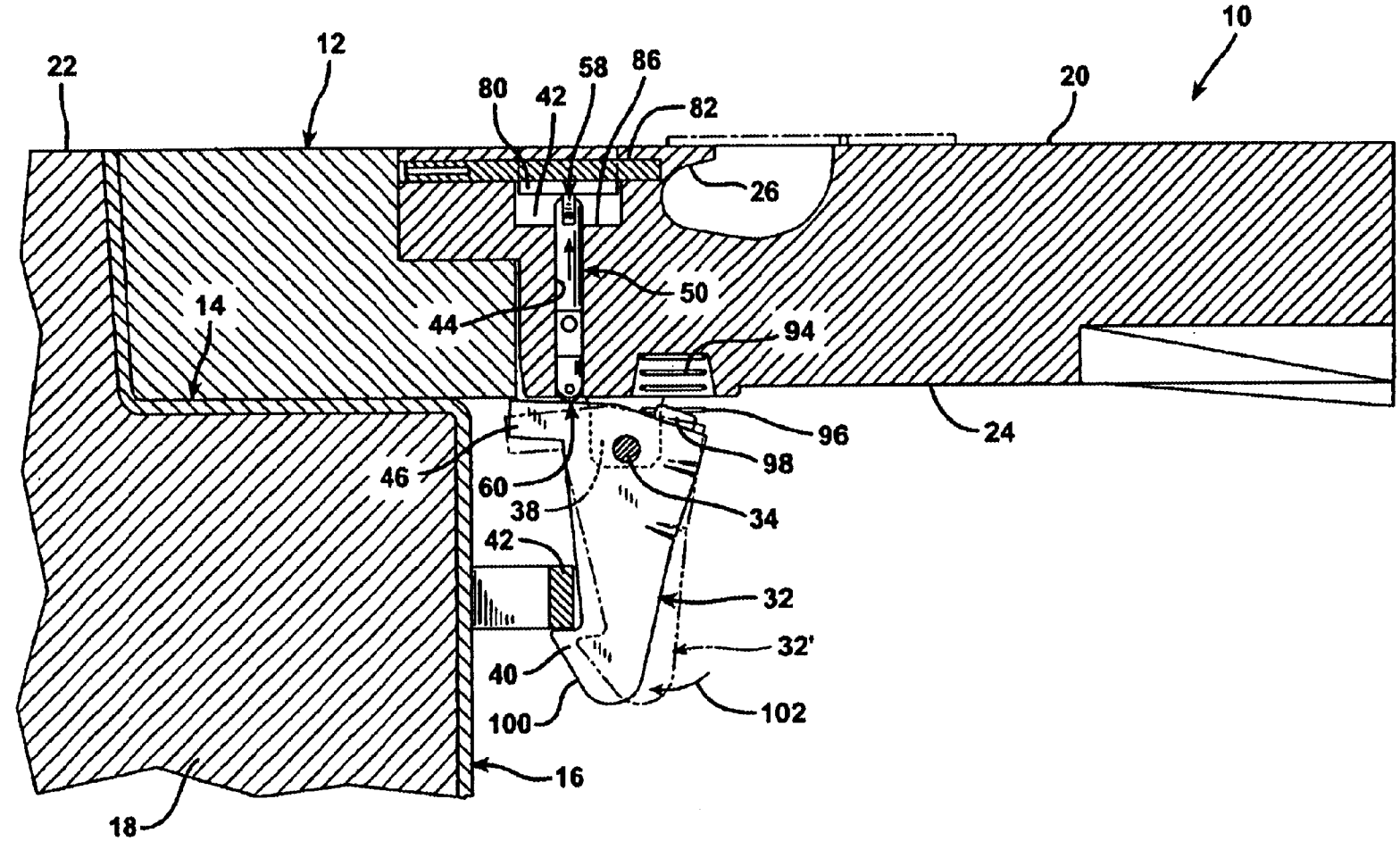
FIG. 3 is a side elevational sectional detail taken along the lines 3—3 in FIG. 1 illustrating the latch mechanism of the invention shown in the catch engaging position.

FIG. 1 illustrates stainless-steel prefabricated aircraft service pit lid 10 which is set into a surrounding frame 12, visible in FIG. 3. The pit lid 10 has a generally rectangular configuration, rounded at its corners. The pit frame 12 is seated atop a peripheral bearing ledge portion 14 formed at the upper extremity of a prefabricated fiberglass aircraft service pit 16. The aircraft service pit 16 is buried in the ground 18 so that the upper surface 20 of the pit lid 10 is flush with the upper surface of the surrounding frame 12 and with the surrounding surface 22 of the tarmac above the ground 18 in which it is buried.

The undersurface 24 of the pit lid 10 is generally parallel to the upper surface 20 and lies in a substantially horizontal orientation when the pit lid 10 is seated in the frame 12, as illustrated in FIG. 3. Concave, scooped out conventional handgrips 26 are defined near the corners of the pit lid 10 proximate the free, unhinged edge 28 which lies opposite the hinged edge 30 of the pit lid 10. The pit lid 10 is hinged for rotation about a horizontal pit lid axis of rotation proximate the hinged edge 30 and parallel thereto.

The aircraft service pit 10 is equipped with a pair of catches 32 which are rigidly joined to a catch mounting rod 34 which in turn is mounted for rotation relative to the pit lid 10 between spaced mounting cars 38. The catch mounting rod 34 is disposed in a horizontal orientation parallel to the free edge 28 of the pit lid 10. The catches 32 are thereby mounted for rotation together about a horizontal axis of catch rotation that lies at the axial center of the catch mounting rod 34.

Each of the catches 32 is rotatable with the catch mounting rod 34 in the manner of a bell crank. Each catch 32 has a hook 40 located remote from the catch mounting rod 34. The hooks 40 of the catches 32 are respectively engageable beneath a set of latch bars 42 that are secured to the upright vertical wall of the prefabricated pit 16. The horizontal latch bars 42 are held at a short distance inwardly toward the interior of the pit cavity from the surface of the pit wall upon which they are mounted.

A generally L-shaped latch operating lever storage recess 42 is defined in the upper surface 20 of the pit lid 10 near one corner thereof proximate the free edge 28. The concave latch operating lever storage recess 42 opens upwardly, so that it is easily accessible from above.

Near one end of the L-shaped latch operating lever storage recess 42 a narrow, cylindrical, actuator rod passageway 44 is formed in the pit lid 10. The passageway 44 extends between the latch operating lever storage recess 42 and the undersurface 24 of the pit lid 10. The actuator rod passageway 44 has an upper opening defined in the floor 86 of the latch operating lever storage recess 42 and a lower opening defined in the undersurface 24 of the pit lid 10 at a spaced distance of separation outboard from the catch mounting rod 34. One of the catches 32 is located in alignment with the actuator rod passageway 44 at the undersurface 24 of the pit lid 10, but in such a manner that it can be moved with a rocking motion by downward pressure on its rocker arm 46. The rocker arm 46 is located directly beneath the actuator rod passageway 44.

A generally cylindrical solid steel actuator rod 50 is disposed for reciprocal movement in the actuator rod passageway 44. The actuator rod 50 is illustrated in isolation in FIG. 4. The actuator rod 50 has pairs of longitudinally oriented clevis ears 52 projecting upwardly and downwardly at its upper and lower ends, respectively. The clevis ears 52 are oriented in pairs to define roller mounting slots 54 and 56 therebetween that are angularly displaced from each other by ninety degrees considered in a horizontal plane.

An upper roller 58 and a lower roller 60 are respectively mounted in the roller slots 54 and 56 for rotation about roller axle pins 62 and 64. The roller 58 and 60 are identical in construction and are each formed of a plurality of ball bearings 66 set in an annular bearing race 68 which is closed by an annular roller bearing faceplate 70.

Figure 4:
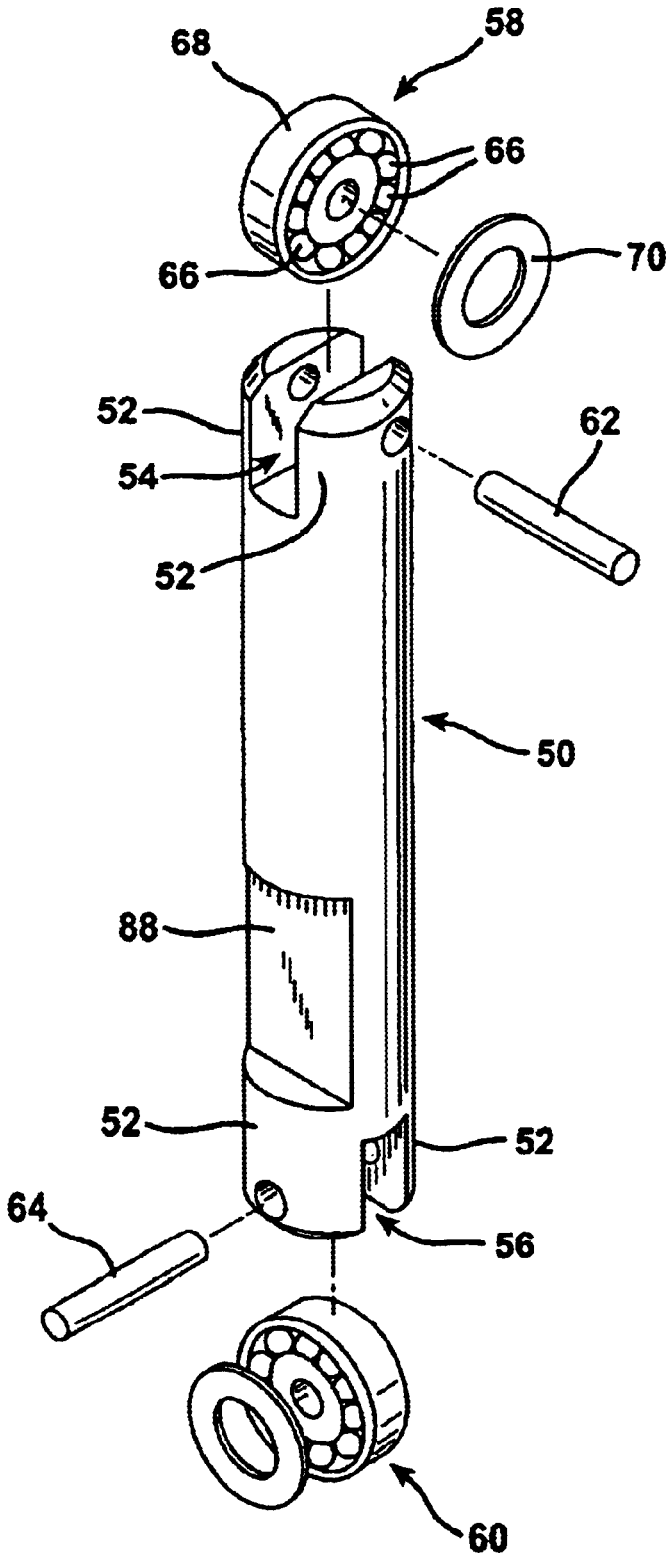
FIG. 4 is an exploded perspective view of the actuator rod and roller mechanisms of the invention.

As best illustrated in FIG. 4, the roller axle pins 62 and 64 are angularly offset from each other by ninety degrees and both pass through the longitudinal axis of the actuator rod 50. The upper and lower axes of rotation of the upper roller 58 and lower roller 60 are angularly displaced from each other by ninety degrees considered in a horizontal plane. The lower roller axle pin 64 upon which the lower roller 60 is mounted is oriented parallel to the axis of rotation of the catches 32, which is the longitudinal axis of the catch mounting rod 34.

Figure 2:
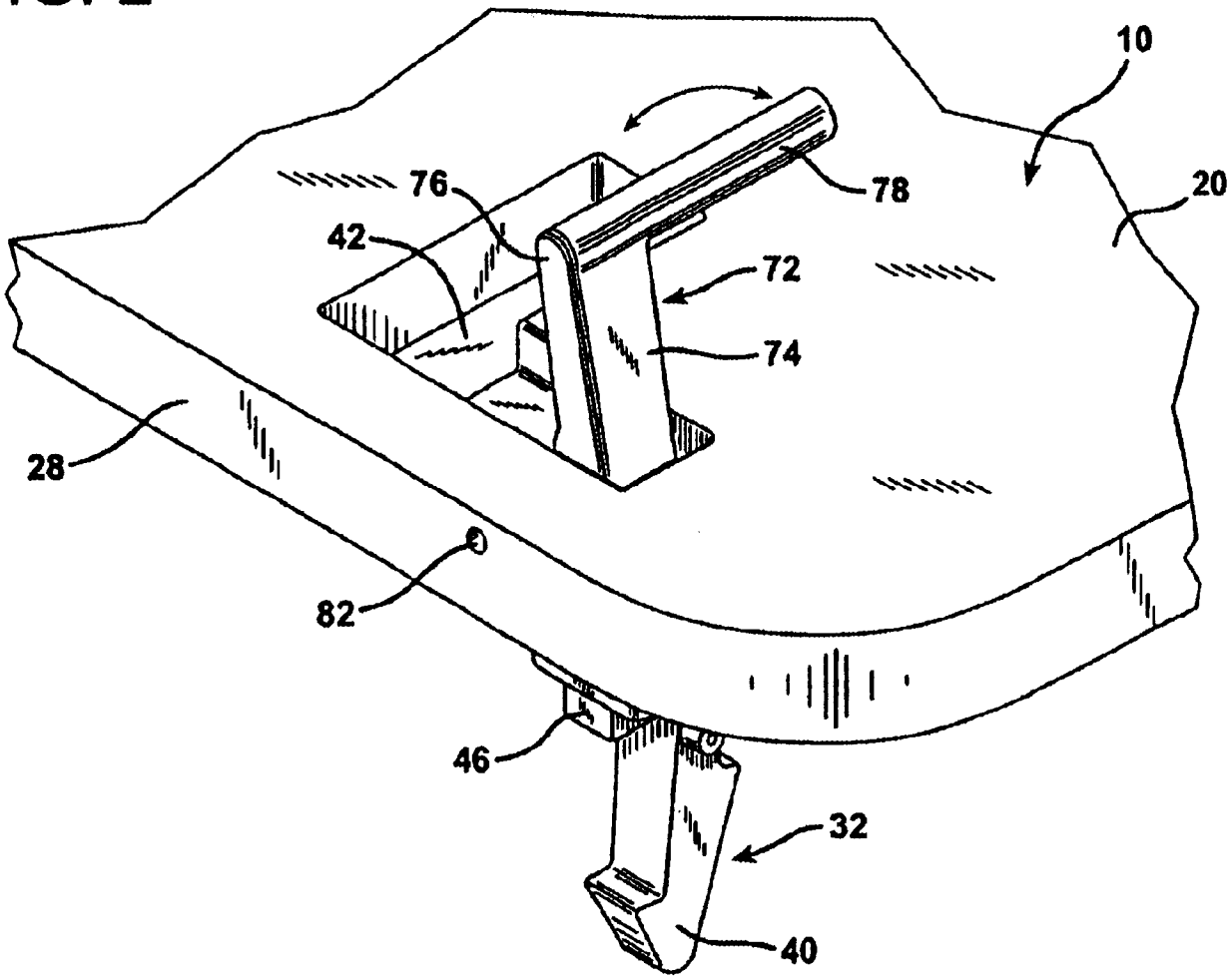
FIG. 2 is a perspective detail illustrating the latch operating lever of the latch mechanism of the invention shown in a raised, catch disengaging position.

A generally L-shaped latch operating lever 72 is provided, as illustrated in FIG. 2. The latch operating lever 72 has a latch operating lever arm 74 with a latch handle end 76. A generally cylindrical handgrip 78 is provided at the latch handle end 76 and is oriented at right angles relative to the latch operating lever arm 74. Both the latch operating lever arm 74 and the handgrip 78 reside within the lateral confines of the latch operating lever storage recess 42 when the latch operating lever 72 is in its lowered position illustrated in FIG. 5.

The latch operating lever arm 74 has an actuator rod operating end 80 opposite its latch handle end 76. The actuator operating rod end 80 is visible in FIGS. 5 and 6. A fulcrum in the form of a latch operating lever mounting pin 82 passes through a fulcrum opening in the latch operating lever arm 74. The fulcrum opening is located between the opposing ends 76 and 80 of the latch operating lever 74. The latch operating lever mounting pin 82 thereby serves as a horizontal operating lever axis of rotation for the latch operating lever 74. It is to be understood in this context that the term "horizontal", as describing the orientation of the latch operating lever axle pin 82, refers to the orientation in which the pin 82 resides when the pit lid 10 is closed, as illustrated in the drawing figures. The upper roller axle pin 62 upon which the upper roller 58 is mounted is oriented parallel to the latch operating lever axle pin 82 and thereby parallel to the operating lever axis of rotation.

Figure 5:
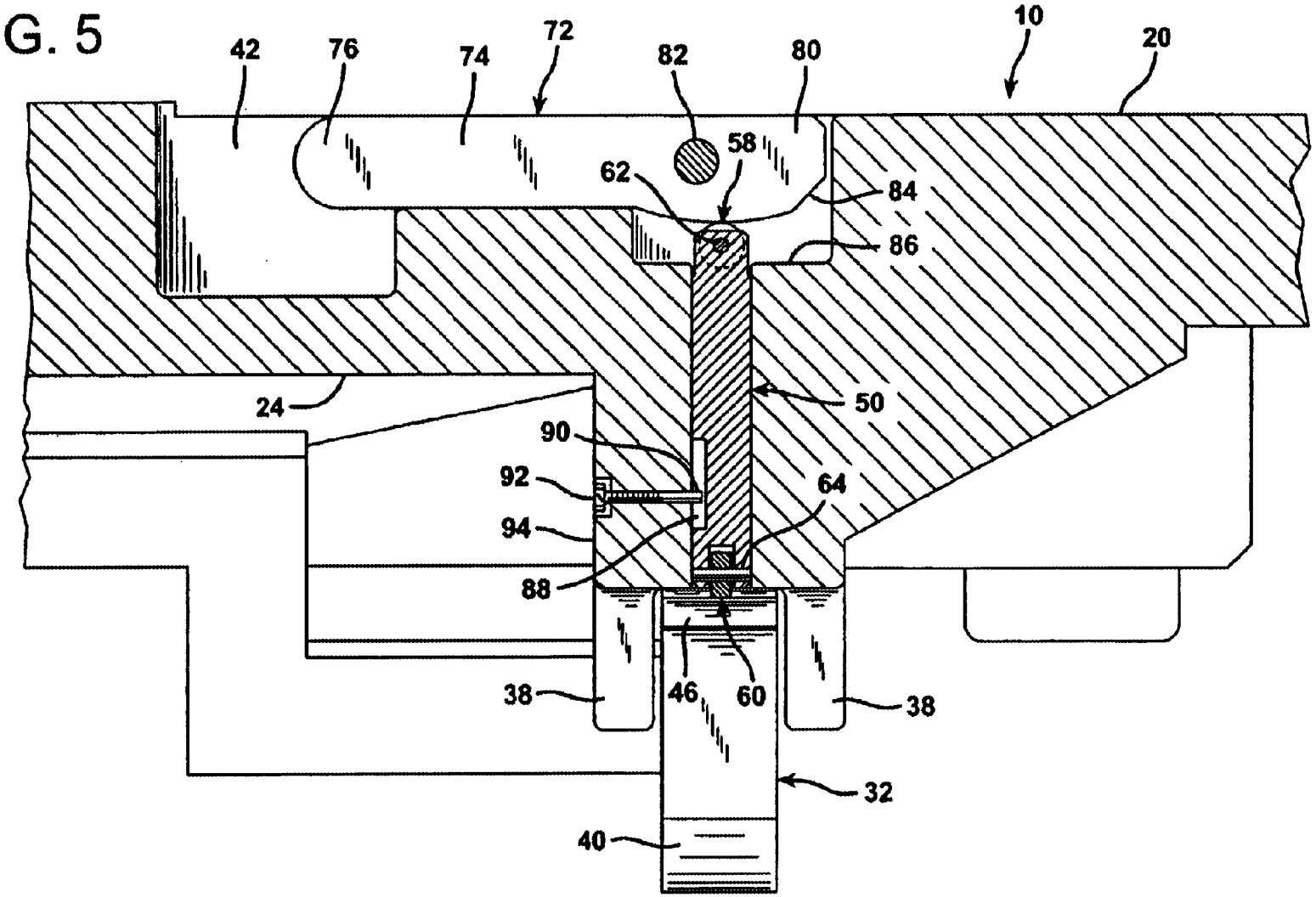
FIG. 5 is a side elevational sectional detail taken along the lines 5—5 in FIG. 1 illustrating the latch mechanism of the invention shown in the catch engaging position.
Figure 6:
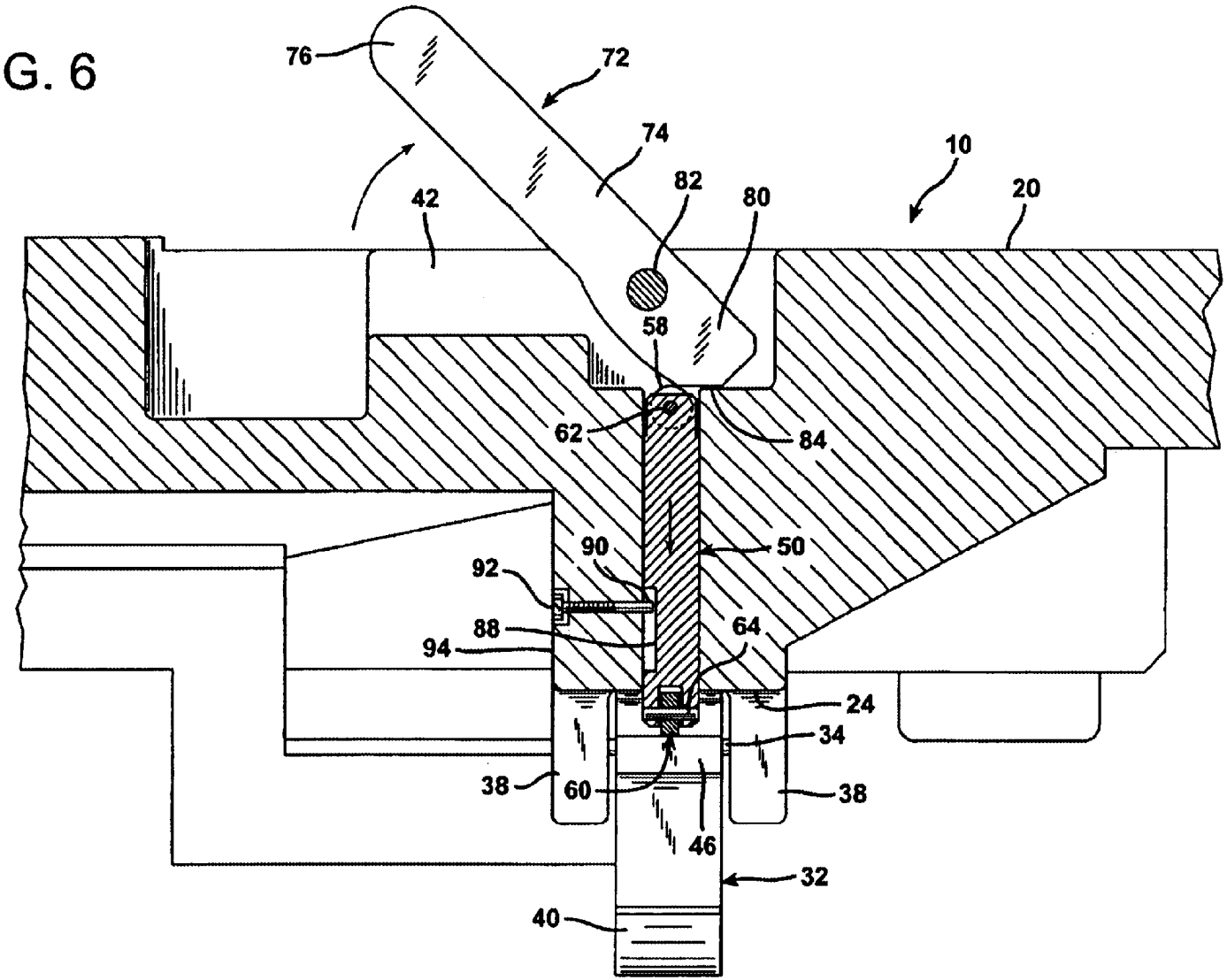
FIG. 6 is a side elevational sectional detail taken along the lines 5—5 in FIG. 1 illustrating the latch mechanism of the invention shown in the catch disengaging position.
Figure 7:
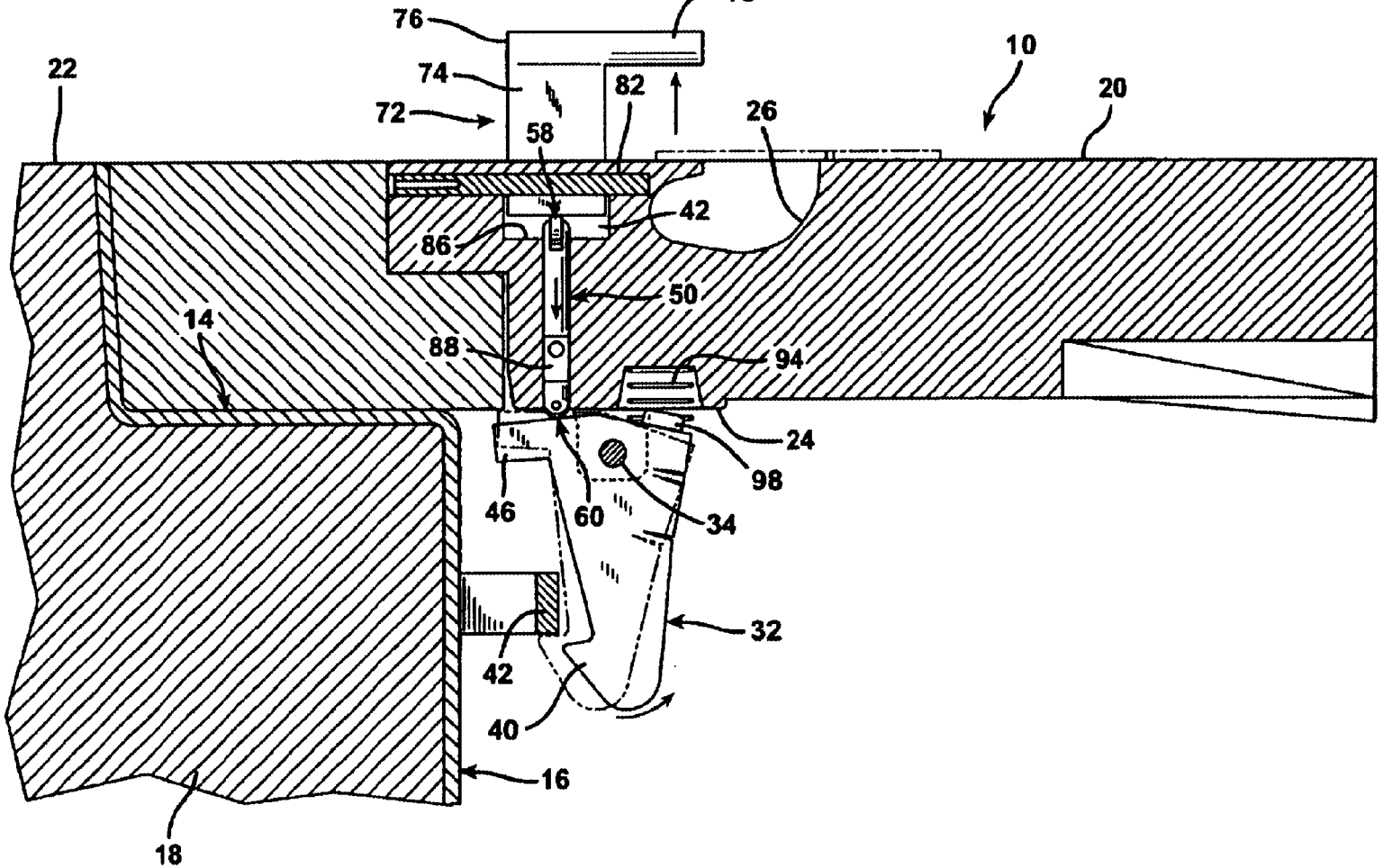
FIG. 7 is a side elevational sectional view taken along the lines 3—3 in FIG. 1 illustrating the latch mechanism of the invention shown in the catch disengaging position.

As shown in drawing FIGS. 5 and 6, the lower corner 84 at the undersurface of the actuator rod operating end 80 of the latch operating lever 74 is flattened at an angle. As illustrated in FIG. 6, when the latch operating lever 74 is lifted by means of the handgrip 78 to its raised position, the flattened face end 84 of the actuator rod operating end 80 of the latch operating lever arm 74 meets the structure of the pit lid 10 at the floor 86 of the latch operating lever storage recess 42. As a consequence, the actuator rod operating end 80 of the latch operating lever 74 is configured to restrict rotation of the latch operating lever 72 to an angle considerably less than ninety degrees. In fact, and as illustrated in FIG. 6, the latch operating lever 72 can be raised to an angle of only about forty-five degrees relative to the alignment of the pit lid 10.

As shown in drawing FIGS. 5 and 6, a longitudinal guideway is formed in the actuator rod 50 as a wide, shallow elongated channel 88. A guide in the form of the distal tip 90 of a threaded machine screw 92 is provided to project into the channel 88. The machine screw 92 is screwed into an internally tapped bore defined in the flange 94 at the underside 24 of the pit lid 10. The distal tip 90 of the machine screw 92 projects into the channel 88 so as to restrict the actuator rod 50 from rotation within the actuator rod passageway 44. This ensures that the lower roller axle pin 64 is held parallel to the catch mounting rod 34 and that the upper roller axle pin 62 is held parallel to the latch operating lever mounting pin 82.

Together, the latch operating lever storage recess 42, the actuator rod passageway 44, the catches 32, the latch bars 42, the actuator rod 50, and the latch operating lever 72 form the latch mechanism of the invention. This latch mechanism releaseably secures the pit lid 10 in the pit lid frame 12 beneath the surface 22 across which aircraft travel.

Preferably, the pit lid 10 is provided at its underside with a shallow spring pocket 94 within which a coil spring 96 is disposed. The lower extremity of the spring 96 bears against the top of at least one of the catches 32 at a laterally spaced distance of separation from the catch mounting rod 34. The coil spring 96 is stabilized by a rubber snub 98. The coil spring 96 is compressed so as to exert a light force against the catch 32 in a clockwise direction as can be seen in FIG. 3. The coil spring 96 thereby biases the catches 32 toward the latched position with the hooks 40 engaged beneath the latch bars 42, as illustrated in FIG. 3.

In the operation of the latching mechanism of the invention the force of gravity will cause the latch operating lever 72 to drop into the latch operating lever storage recess 42 when the pit lid 10 is in the closed position as shown in the drawing figures. The force of the coil spring 96 is sufficient to overcome the opposing force of the weight of the actuator rod 50 and thereby rotate the catches 32 to the latched position illustrated in FIG. 3 so that the catch hooks 40 engage the latch bars 42.

To disengage the catch hooks 40, the user lifts upwardly on the latch handle handgrip 78 to rotate the latch operating lever 72 upwardly and out of the latch operating lever storage recess 42, as illustrated in FIG. 2. There is just sufficient space in the latch operating lever storage recess 42 adjacent the latch handle handgrip 78 to permit insertion of the fingers of one hand in order to grip the latch handle handgrip 78.

When the latch handle handgrip 78 is pulled upwardly to rotate the latch operating lever 72 from the engaged position illustrated in FIGS. 3 and 5 to the disengaged position illustrated in FIGS. 2 and 6, the latch operating lever 72 rotates about the latch operating level axle mounting pin 82, thereby bringing the actuator rod operating end 80 of the latch operating lever arm 74 to bear against the upper roller 58. The use of rolling contacts at both the upper and lower ends of the operating rod 50 ensure that the force is exerted on the actuator rod 50 in a straight, longitudinally axial direction along the length of the actuator rod passageway 44. This prevents the actuator rod 50 from jamming or binding within the passageway 44.

As the actuator rod 50 is forced downwardly the lower roller 60 bears against the rocker arm 46 of the catch 32, thereby rotating it to the position indicated in FIG. 6 and in phantom at 32' in FIG. 3. The downward force of the actuator rod 50 on the catch rocker arm 46 is sufficient to overcome the bias of the compressed spring 96. As a result, the hooks 40 are disengaged from the latch bars 42 when the catches 32 are in the positions indicated at 32' in FIG. 3. The user can than lift the pit lid 10 in rotation relative to the frame 12 to open it by gripping it at the handgrip openings 26.

When the pit lid 10 is to be closed, it is simply dropped back into position. The force of gravity will cause the pit lid 10 to seat in a horizontal disposition in the frame 12 as illustrated in the drawing figures. As the pit lid 10 descends, the cam surfaces 100 of the catch hooks 40 contact the latch bars 42 and cause the catches 32 to counterrotate against the force of the coil spring 96 so as to allow the catch hooks 40 to clear the latch bars 42. Once the hooks 40 have cleared the undersurfaces of the latch bars 42, the force of the coil spring 96 is sufficient to counterrotate the catches 32 as indicated by the directional arrow 102 in FIG. 3 to once again cause the catch hooks 40 to engage the latch bars 42.

Since the catches 32 are mounted for rotation together with the catch mounting bar 34, is necessary to provide only a single latch operating handle 72 on one side of the pit lid 10, as illustrated in FIG. 1. Preferably, a narrow, cylindrical vertical passage 104 is provided directly above the catch rocker arm 46 of the other catch 32, remote from the catch 32 at which the latch operating handle 72 is located. This vertical passage 104 is normally sealed with a watertight plug. However, should there be some failure in the latching mechanism, the watertight plug can be removed and a narrow cylindrical wire rod can be forced down the passage 104 to disengage the catches 32.

Undoubtedly, numerous variations and modifications of the invention will become readily apparent to those familiar with subsurface aircraft servicing pits. For example, while the preferred embodiment of the invention illustrated employs a pair of catches 32 and a pair of latch bars 42 located near both corners of the pit lid 10 near the free edge 28 thereof, it is apparent that the use of a single catch 32 would suffice. Also, different types of rollers and spring biasing mechanisms may be employed in place of the preferred arrangements illustrated. Accordingly, the scope of the invention should not be construed as limited to this specific embodiment depicted and described, but rather is defined in the claims appended hereto.

We claim:

1. An aircraft servicing pit latch mechanism for holding and releasing a pit lid mounted in a frame atop a subsurface aircraft servicing pit, wherein said pit lid has an upper surface and an undersurface comprising: a latch operating lever storage recess defined in said upper surface of said pit lid, an actuator rod passageway formed in said pit lid and extending between said latch operating lever storage recess and said undersurface of said pit lid, a catch located in alignment with said actuator rod passageway at said undersurface of said pit lid and mounted for rotation about a horizontal axis of catch rotation, an actuator rod disposed for longitudinal, reciprocal movement in said actuator rod passageway, a latch operating lever having opposing latch handle and actuator rod operating ends mounted between said opposing ends to said pit lid for rotation at a fulcrum about a horizontal latch operating lever axis of rotation for movement between a stored position residing within the lateral confines of said latch operating lever storage recess and an actuator rod engaging position in which said latch handle end is raised out of said latch operating lever storage recess while said actuator rod operating end depresses said actuator rod to disengage said catch.

2. An aircraft servicing pit latch mechanism according to claim 1 wherein said actuator rod has opposing upper and lower ends and further comprising a pair of rollers, one located at each of said upper and lower ends of said actuator rod, and said roller at said lower end of said actuator rod is mounted thereto on a lower roller axle oriented parallel to said axis of catch rotation and said roller at said upper end of said actuator rod is mounted thereto on an upper roller axle oriented parallel to said latch operating lever axis of rotation.

3. An aircraft servicing pit latch mechanism according to claim 2 wherein said rollers are comprised of roller bearings.

4. An aircraft servicing pit latch mechanism according to claim 2 further comprising a longitudinal guideway in said actuator rod and a guide secured to said pit lid and projecting into said guideway to restrict said actuator rod in rotation within said actuator rod passageway.

5. An aircraft servicing pit latch mechanism according to claim 2 wherein said upper and lower axes of roller rotation are angularly displaced from each other by ninety degrees considered in a horizontal plane.

6. An aircraft servicing pit latch mechanism according to claim 2 wherein said latch operating lever is provided with a handgrip at its latch handle end oriented at right angles thereto, and said latch handgrip also resides within the lateral confines of said latch operating lever storage recess when said latch operating lever is in said stored position.

7. An aircraft servicing pit latch mechanism according to claim 2 further comprising a spring biasing said catch toward an engaged position.

8. An aircraft servicing pit latch mechanism according to claim 1 wherein said rod actuating end of said latch operating lever meets the structure of said pit lid when said latch operating lever is in said actuator rod engaging position to restrict rotation of said latch operating lever to an angle of less than ninety degrees.

9. A latching mechanism for releaseably securing a pit lid having an upper surface and an undersurface and seated in a pit lid frame of a pit buried beneath a surface across which aircraft travel when not in flight comprising:

a catch depending from said undersurface of said pit lid and mounted for rotation about a horizontal catch axis of rotation relative to said pit lid between engaged and disengaged positions, a latch operating lever storage recess formed in said upper surface of said pit lid vertically above said catch, an actuator rod passageway defined through said pit lid and leading between said latch operating lever storage recess and said undersurface of said pit lid, an actuator rod mounted for longitudinal, reciprocal movement within said actuator rod passageway, and said actuator rod is depressible to bear against said catch to disengage it from said pit, and a latch operating lever having opposing handle and actuator rod engaging ends and said lever is hinged to said pit lid between its opposing ends and is rotatable about a horizontal fulcrum between a storage position residing within the lateral confines of said latch operating lever storage recess and a raised position in which said handle end is lifted out of said latch operating lever storage recess and said actuator rod engaging end depresses said actuator rod into said actuator rod passageway.

10. A latching mechanism according to claim 9 wherein said actuator rod has opposing upper and lower ends and further comprising a pair of rollers, one located at each of said upper and lower ends of said actuator rod, and said roller at said lower end of said actuator rod is mounted thereto on a lower roller axle oriented parallel to said axis of catch rotation and said roller at said upper end of said actuator rod is mounted thereto on an upper roller axle oriented perpendicular to said latch operating lever.

11. A latching mechanism according to claim 9 further comprising a longitudinal guideway in said actuator rod and a guide secured to said pit lid and projecting into said guideway to restrict said actuator rod in rotation within said actuator rod passageway.

12. A latching mechanism according to claim 9 wherein said catch and said latch operating lever are rotatable about axes of rotation that lie in parallel planes and which are angularly displaced at right angles from each other.

13. A latch operating mechanism according to claim 9 wherein said latch operating lever is provided with a handgrip at its latch handle end oriented at right angles thereto, and said handgrip also resides within the lateral confines of said latch operating lever storage recess when said latch operating lever is in said storage position.

14. A latch operating mechanism according to claim 9 further comprising a spring mounted in said pit lid biasing said catch toward an engaged position.

15. In a subsurface pit for use below a surface across which aircraft travel on the ground having a pit lid frame and a pit lid with an upper surface and an undersurface wherein said pit lid is set in said frame and which can be lifted relative to said frame, and a pivoted catch located beneath said pit lid at said undersurface thereof and engageable with said pit to hold said pit lid seated in said frame, the improvement comprising:

a latch operating lever storage recess defined in said upper surface of said pit lid above said pivoted catch, an actuator rod passageway defined through said pit lid and terminating in an upper opening in said latch operating lever storage recess and a lower opening at said undersurface of said pit lid in registration with said pivoted catch, an actuator rod disposed in said actuator rod passageway for longitudinal, reciprocal movement therewithin, wherein said actuator rod is depressible downwardly to bear against said pivoted catch so as to disengage said pivoted catch relative to said pit, and a latch operating lever having opposing latch handle and actuator rod engaging ends, and pivotally mounted between said ends to said pit lid proximate said upper surface thereof and rotatable between a catch engaging position lying completely within the lateral confines of said latch operating lever storage recess and a raised position in which said latch operating lever depresses said actuator rod downwardly to disengage said catch.

16. A subsurface pit according to claim 15 wherein said actuator rod has opposing upper and lower ends and further comprising a pair of rollers, one located at each of said upper and lower ends of said actuator rod, and said roller at said upper end of said actuator rod is mounted thereto on an upper roller axle oriented perpendicular to said latch operating lever, and said roller at said lower end of said actuator rod is mounted thereto on a lower roller axle oriented perpendicular to said upper roller axle.

17. A subsurface pit according to claim 15 further comprising a longitudinal guideway in said actuator rod and a guide secured to said pit lid and projecting into said guideway to limit said actuator rod in rotational movement within said actuator rod passageway.

18. A subsurface pit according to claim 15 further comprising a catch axle mounted to said pit lid and upon which said catch is mounted for rotational movement, and a pair of rollers, one located at each of said upper and lower ends of said actuator rod, and said roller at said lower end of said actuator rod is mounted thereto on a lower roller axle oriented parallel to said catch axle and said roller at said upper end of said actuator rod is mounted thereto on an upper roller axle oriented parallel to said latch operating lever and said upper and lower roller axles are angularly displaced from each other by ninety degrees considered in a horizontal plane.

19. A subsurface pit according to claim 15 further comprising a spring interposed between said catch and said pit lid and biasing said catch toward a position engaged with said pit.

20. A subsurface pit according to claim 15 wherein said actuator rod engaging end of said latch operating lever meets the structure of said pit lid in abutment thereagainst to restrict rotation of said latch operating lever to an acute angle relative to the orientation of said pit lid.

* * * * *